US005447106A

United States Patent [19]

Baird

[11] Patent Number: 5,447,106

[45] Date of Patent: Sep. 5, 1995

[54] COKE OVEN RAIL CAR WITH DRIVE CONTROL SYSTEM FOR POSITIONING THE CAR HAVING GROSS AND FINE POSITIONING DRINKS

[75] Inventor: Billy C. Baird, Sturgis, Ky.

[73] Assignee: Saturn Machine & Welding Co., Inc., Sturgis, Ky.

[21] Appl. No.: 56,113

[22] Filed: Apr. 30, 1993

[51] Int. Cl.[6] ..... B60L 15/00

[52] U.S. Cl. ..... 104/295; 104/154; 105/130; 246/167 R; 414/188; 414/198; 414/352; 414/584; 74/128; 74/160

[58] Field of Search ..... 104/154, 295; 105/32, 105/96.1, 128, 130; 246/167 R; 414/172, 188, 198, 273, 352, 396, 401, 584; 192/85 AA; 74/128, 160

[56] References Cited

U.S. PATENT DOCUMENTS

| | | | |
|---|---|---|---|
| 2,797,795 | 7/1957 | West | 74/128 X |
| 3,300,697 | 1/1967 | Woodford | 74/128 X |
| 3,784,034 | 1/1974 | Thompson | 414/188 X |
| 4,248,562 | 2/1981 | Tsuzuki et al. | 414/584 X |
| 4,415,975 | 11/1983 | Burt | 414/273 X |
| 4,494,905 | 1/1985 | Yamaji et al. | 414/584 |
| 4,597,709 | 7/1986 | Yonezawa | 414/401 |

*Primary Examiner*—Robert J. Oberleitner
*Assistant Examiner*—S. Joseph Morano
*Attorney, Agent, or Firm*—Wood, Herron & Evans

[57] ABSTRACT

A coke oven rail car with a drive control system for positioning the car and for spotting the functional equipment carried by the car. A sensor determines the relative position of the car with respect to a selected oven in a coke oven battery. The car includes a first drive for effecting gross movement of the car along the rails and gross positioning of the car relative to the selected oven. The car further includes a second automatically controlled drive for effecting fine movement of the caw along the rails and fine positioning of the car relative to the selected oven. In one embodiment the first drive is manually controlled, while in another embodiment the first drive is automatically controlled. The second automatically controlled drive can take the form of one or two disk clutch type mechanisms or a clutch band type mechanism.

21 Claims, 8 Drawing Sheets

COKE OVEN RAIL CAR WITH DRIVE CONTROL SYSTEM FOR POSITIONING THE CAR HAVING GROSS AND FINE POSITIONING DRINKS

FIELD OF THE INVENTION

This invention relates generally to rail cars, and more particularly to a rail car known as a pusher machine or door machine used at the site of a coke oven battery including a plurality of coke ovens. More particularly, the invention relates to a drive control system for positioning the coke oven pusher machine or door machine relative to a selected oven in the battery or other machinery in other environments that require positioning.

BACKGROUND OF THE INVENTION

A coke plant which manufacturers coke from coal for subsequent use in blast furnaces or foundries for making iron therefrom employs one or more coke oven batteries. A coke oven battery is a bank of coke ovens positioned side by side. A coke oven battery can contain a fairly substantial number of coke ovens, spanning a length of several hundred feet.

One side of the coke oven battery is known as the "pusher" side, while the opposite side of the coke oven battery is known as the "door" or "coke" side. On the pusher side, there is a set of railroad type rails or tracks running the length of the battery. Along this set of rails or tracks there rides what is known as a "pusher side machine" or simply "pusher machine". This pusher machine can weigh on the order of 60 to 220 tons, and carries a variety of equipment which is used in conjunction with the coke oven battery. The pusher machine normally incorporates a number of pieces of functional equipment for use in servicing the ovens, including a door extractor for removing and reattaching an oven door to its oven, a door cleaner for cleaning foreign material from the oven door, an oven jamb cleaner for cleaning foreign material from the oven jamb, a pusher ram for pushing the coke through the oven and out the opposite door, and a leveler for insertion through a separate leveler door at the upper end of the coke oven door for levelling the coal loaded from above into the oven.

The opposite side of the coke oven battery, known as the "coke side", similarly includes a set of rails or tracks, with a somewhat smaller "coke side machine" or simply "coke machine" or "door machine" that rolls therealong. The door machine similarly includes a door extractor, a door cleaner and a jamb cleaner, but includes no pusher ram or leveler. The door machine includes a coke guide which is a rectangularly cross-sectioned chute used for directing the coke from the coke oven over and across the set of rails or tracks and into one or more conventional railway cargo cars known as "hot cars".

In order to utilize the various pieces of equipment on either the pusher machine or door machine in conjunction with a selected oven, the piece of equipment carried by the machine must be aligned with the vertical centerline axis of symmetry of the selected oven which is to be serviced. Positioning the equipment carried by the machine so that its vertical centerline axis of symmetry is aligned with that of the selected oven is known as placing the machine or equipment "on spot".

Some coke plants still use the visual method whereby the operator looks across a sight in the cab to line up on a mark on a buckstay or other structure. Others use a hydraulic cylinder mounted on the door or pusher machine with a receptacle mounted on buckstays or other structures and the operator extends the cylinder shaft into the receptacle having a limit switch to signal success. Some coke plants have tried laser spotting systems but not very successfully. The laser fires a beam to a mark on a buckstay.

Another type of completely manual system for placing the functional equipment of the machine "on spot" has been developed and marketed by the assignee of the present invention. In that spotting system, the pusher or door machine has installed on the top thereof a sprocket driven 500 count encoder/pulse generator having a high speed count/pulse module. An encoder chain is mounted from the face of the battery, e.g. the hot rail outriggers to span the length of the coke oven battery, and is positioned to mesh with the sprocket driven encoder as the machine travels along the tracks. This system further includes a programmable logic controller having a minimum of 6K of memory, 16 bits of discrete inputs, 16 bits of discrete outputs, a chassis, a power supply for the chassis, a Panelview display for operator input and display output, and a limit switch for resetting the encoder at the zero location all purchased from Allen Bradley. As the machine travels down the tracks, the encoder sprocket is driven by the encoder chain. The computer is programmed with the position along the chain corresponding to the position of the centerline axis of each oven; therefore for a particular position of the machine along the chain and hence tracks the computer knows the distance between the machine, and hence the functional equipment carried by the machine, and the centerline of any selected oven. Consequently, via the Panelview display, the computer will indicate to an operator the direction the machine must travel in order to align the selected piece of equipment carried by the machine with the selected oven. The operator energizes the travel controller by pushing the appropriate button on the Panelview display to move the machine in one direction along the rails, or reverses the travel controller to move the machine in the other direction along the rails. The Panelview display continues to indicate the direction in which the car is required to be moved to align the piece of equipment with the selected oven. When the machine gets near the selected oven the operator slows the machine, and then gradually moves the machine on spot using the manually operated travel controller. Should the operator cause the machine to overshoot the on spot position, the Panelview display simply indicates that the machine must then be moved in the opposite direction. The operator so jockeys the machine with the manual travel controller until the Panelview display indicates on spot.

The resolution of the sprocket driven encoder in combination with the chain is on the order of plus or minus 0.025 inch. However, due to the limitations of a human operator's manual dexterity in operating the travel controller, an operator is normally only able to position or spot the machine and its associated equipment within plus or minus ½" of the true on spot position. Consequently, via this manual type of spotting, an operator is unable to exploit the resolution of the encoder as he is normally off of true on spot by plus or minus ½". By being off by as much as plus or minus ½", the equipment carried by the pusher machine and door machine can be damaged, and can damage the coke oven door and the door jamb. For example, when replacing a door that has been extracted from its oven, a variation of plus or minus ½" from true on spot can greatly damage the seal of the coke oven door and/or the jamb of the coke oven itself. This damage results in downtime of the oven and costly repair is required to repair the door jamb and/or door seal. Similarly, if the jamb cleaner is off by as much as plus or minus ½", it likewise can become damaged and/or damage the door jamb. The same is true if the pusher ram is off by as much as plus or minus ½".

SUMMARY OF THE INVENTION

It has been a main objective of the present invention to more completely utilize and take advantage of the linear resolution of the sprocket driven chain and encoder linear position sensing systems employed with pusher and door side machines and coke oven batteries in order to more accurately position the functional equipment carried by the pusher and coke or door side machines with respect to a selected oven.

It has been another objective of the present invention to reduce the amount of damage inflicted upon coke oven doors and door seals, coke oven jambs, coke oven jamb cleaners, etc., by devising a device which more accurately places these functional components "on spot" relative to a selected oven.

In accordance with the stated objectives, the present invention provides a coke oven rail car with a drive control system for positioning the car and for spotting the functional equipment carried by the car. The car is adapted to roll on rails adjacent to and along the length of the coke oven battery which includes a plurality of coke ovens. A sensor determines the relative position of the car with respect to a selected oven in the battery. The car includes a first drive for effecting gross movement of the car along the rails and gross positioning of the car relative to the selected oven on the basis of the first position determined by the sensor of the car relative to the selected oven. The car further includes a second automatically controlled drive for effecting fine movement of the car along the rails and fine positioning of the car relative to the selected oven on the basis of the second position determined by the sensor of the car relative to the selected oven.

In one embodiment of the present invention, in so-called "semi-automatic" mode, the first drive is manually controlled, while in another embodiment, in so-called "fully automatic" mode, the first drive is automatically controlled.

The first manually controlled drive comprises a first drive assembly, a motor for driving the first drive assembly, and a manual operator controller for manually controlling the motor whereby an operator can position the car in a first selected position relative to the selected oven with the first drive assembly. In the other embodiment, the first automatically controlled drive comprises a first drive assembly, a motor for driving the first drive assembly, and a first automatic controller for automatically controlling the motor whereby the car is automatically positioned in the first selected position relative to the selected oven with the first drive assembly.

In both embodiments, the second automatically controlled drive comprises a second drive assembly, an actuator for actuating the second drive assembly, and an automatic controller for automatically controlling the actuator and the second drive assembly whereby the car is automatically positioned in the second selected position relative to the selected oven with the second drive assembly.

The invention contemplates that the second drive assembly comprise either a disk clutch mechanism or a band clutch mechanism for driving a wheel axle of the car, and that the actuator comprise a hydraulic cylinder or hydraulic or electric motor connected between the car and the disk clutch mechanism or the band clutch mechanism.

The disk clutch mechanism can take one of two forms. In one form the mechanism comprises a disk mounted to the wheel axle, a support bracket mounted to the car adjacent the axle, a caliper bracket movably mounted on the support bracket, the caliper bracket being moveable relative to the support bracket about an axis of rotation of the wheel axle, the caliper bracket including at least one caliper for cooperation with the disk, with the automatic controller being operable to clamp and release the caliper to and from the disk and for extending and retracting the hydraulic cylinder.

In the other form of the disk clutch mechanism, the mechanism comprises a disk mounted to the wheel axle, and a caliper bracket mounted to a hub. The hub is movably mounted relative to the wheel axle about an axis of rotation of the wheel axle, and includes at least one caliper for cooperation with the disk, with the automatic controller being operable to clamp and release the at least one caliper to and from the disk and for extending and retracting the hydraulic cylinder.

The band clutch mechanism comprises a drum mounted to the wheel axle, a clutch band encircling the drum, and a band tightening cylinder connected to opposite ends of the band, with the automatic controller being operable to clamp and release the brake band to and from the drum with the band tightening cylinder and for extending and retracting the hydraulic cylinder and/or energizing the hydraulic or electric motor.

The invention further contemplates the utilization of a brake in conjunction with the second automatically controlled drive, with the automatic controller being operable to actuate the brake for decelerating the car and maintaining the car in the second selected position.

A primary advantage of the present invention is that the resolution of the chain driven sprocket encoder, commonly used on pusher and door machines, can more effectively be utilized by fully exploiting its resolution to position a pusher or door car within plus or minus 0.025" of true on spot, rather than the plus or minus ½" attainable when relying only on an actuator's manual dexterity and coordination.

Another advantage of the present invention is that savings accrue and downtime is eliminated in that coke oven doors, door seals, jambs and jamb cleaners are not damaged when an oven is attempted to be serviced by the functional equipment when the machine and hence equipment are not completely "on spot".

These and other objects and advantages of the present invention will become more readily apparent during the following detailed description taken in conjunction with the drawings herein, in which:

DETAILED DESCRIPTION OF THE INVENTION

Figure 1:
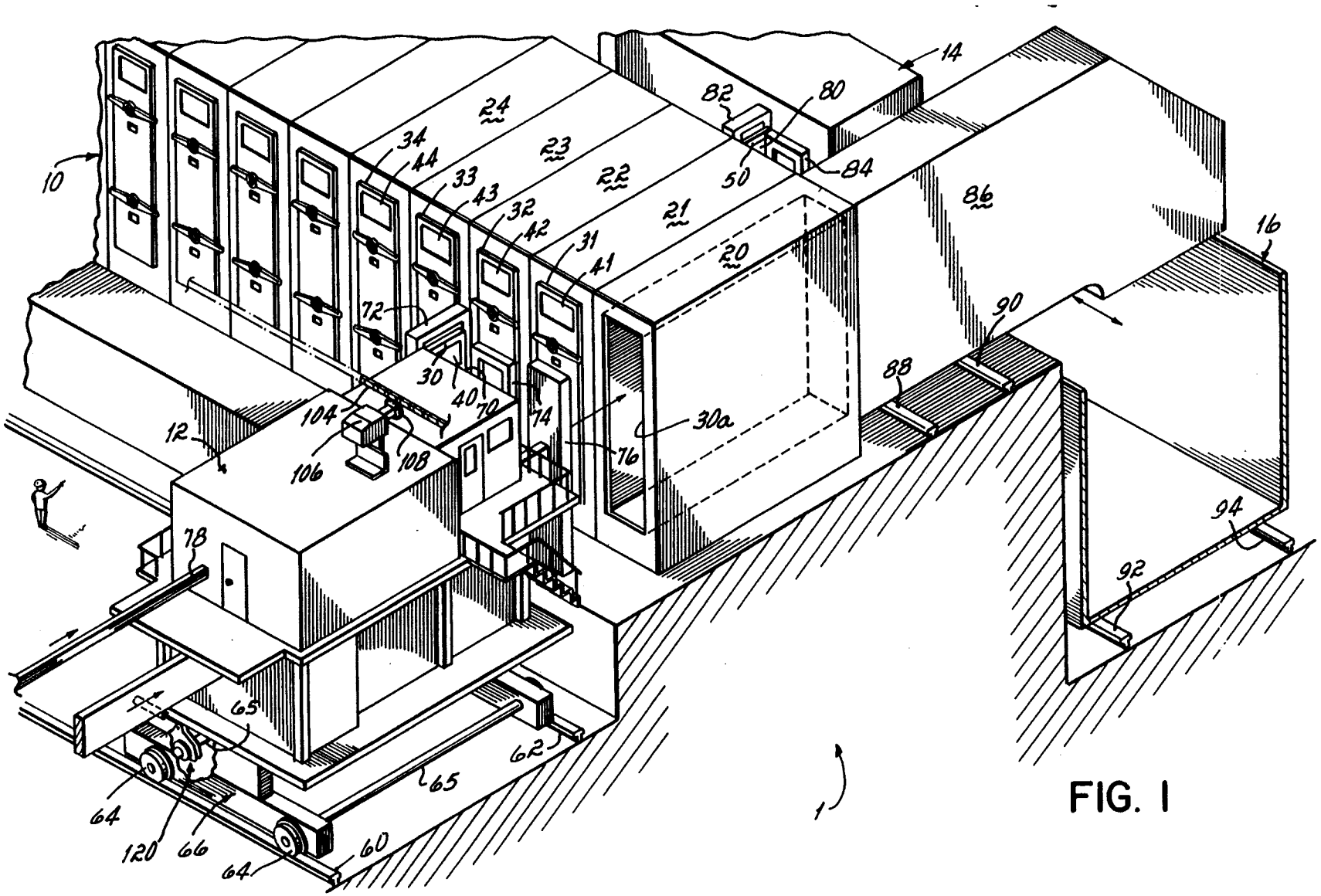
FIG. 1 is a partial perspective view of a portion of a coke plant illustrating coke oven battery, pusher side machine, door or coke side machine and hot car.

With reference first to FIG. 1, there is illustrated a portion of a coke plant 1 which includes, generally, a coke oven battery 10, a pusher side machine 12, a door or coke side machine 14 and a hot car 16.

More particularly, coke oven battery 10 includes a plurality of coke ovens 20–24, each of which includes a respective pusher side oven door 30–34. The pusher side coke oven doors 30–34 include at an uppermost location a small leveler door 40–44. The opposite ends of the coke ovens 20–24 include oven doors similar to those illustrated at 30–34, yet do not include the small upper leveler door. One of the doors on the door or coke side is shown removed from oven 20 and is designated by the numeral 50.

The pusher machine 12 is essentially a large rail car which rolls atop a pair of tracks 60, 62. The car 12 includes rail wheels 64 for riding atop the rails 60, 62. Wheels 64 are mounted to axles 65 which are rotatably supported in pusher machine base support structure 66. The pusher machine 12 incorporates a number of pieces of functional equipment used in servicing the coke oven battery 10. The pusher machine 12 includes a door extractor 70 for removing the door 30 from its respective oven 20, a door cleaner 72 for cleaning the door 30 upon the door extractor 70 rotating the door through approximately 90 degrees from the oven 20 to face the door cleaner 72, and a jamb cleaner 74 for cleaning the jamb 30*a* of oven 20 once door 30 has been removed therefrom. In addition, the pusher machine 12 further includes a pusher ram 76 for pushing the coke all the way through the oven 20 and out the rearward or door side, and a leveler 78 which is inserted through the upper leveler door 40 of door 30 after oven 20 has been loaded with coal, for leveling the coal across the top of the oven.

Similarly, the door or coke side machine or door machine 14 likewise includes a door extractor 80 for removing and reattaching door 50 from and to the oven 20, a door cleaner 82 for cleaning the door 80 after removal from the oven 20, and a jamb cleaner 84. The door side machine 14 includes no pusher ram or leveler, but does include a coke guide 86 for directing the coke over the tracks 88, 90 upon which the door or coke side machine rolls, and into the hot car 16, which itself rolls on tracks 92, 94.

Figure 2:
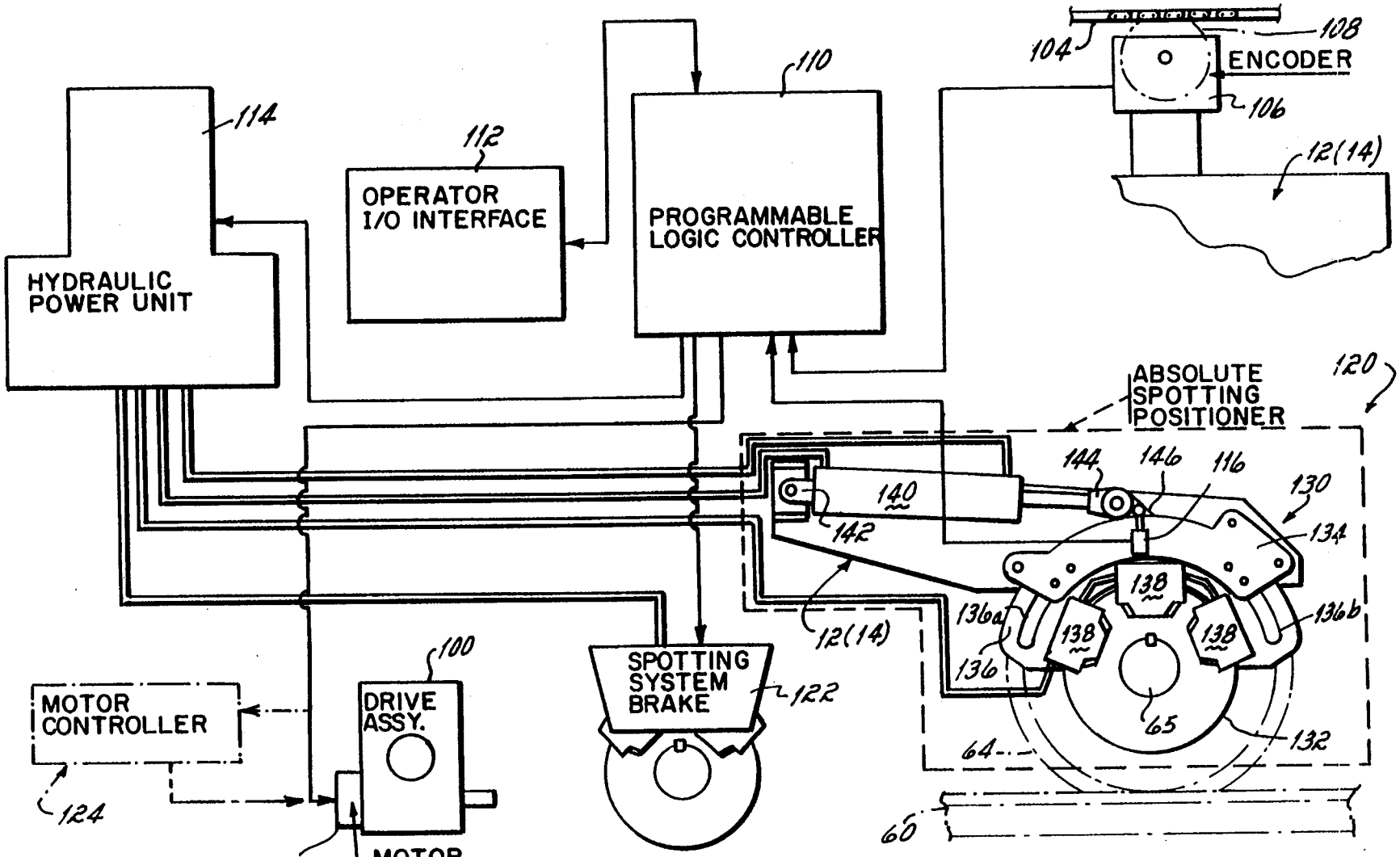
FIG. 2 is a schematic diagram illustrating the components for both the semi-automatic and fully automatic positioning or spotting system of the present invention.

With reference now to FIGS. 1 and 2, the pusher machine 12 is driven along the rails 60, 62 via a first drive comprising a drive assembly 100 and corresponding motor 102. The drive assembly 100 and motor 102 effect rotation of one of the pair of axles 65,65. The drive assembly 100 and motor 102 effect gross movement of the pusher machine 12 along the tracks 60,62 for gross positioning of the car 12 relative to a selected oven in the coke oven battery 10, and as illustrated in FIG. 1, relative to oven 20.

In order to provide gross positioning of the pusher machine 12 relative the selected oven, a chain 104 is strung the length of the coke oven battery 10. The chain 104 is preferably mounted to the hot rail outriggers or other suitable structure (not shown, but known to those skilled in the art). There is an encoder 106 mounted to the upper side of the pusher machine 12 which includes an encoder drive sprocket 108 for meshing engagement with the chain 104.

Referring now to FIG. 2, the encoder 106 sends signals to a programmable logic controller 110, which sends and accepts signals to and from an operator I/O interface 112. The encoder 106 sends a signal to the programmable logic controller 110 of the location of the machine 12; the programmable logic controller 10 determines the direction and distance to be traveled by the machine 12 and displays this information to the operator. Based on the location of the machine 12, the operator I/O interface 112 informs an operator the direction in which the machine 12 is required to be traveled based upon the oven selected for servicing and the functional equipment on the machine 12 to perform the service.

A hydraulic power unit 114 accepts signals from the programmable logic controller 110. The hydraulic power unit 114 provides power to a second drive which takes the form of an absolute spotting positioner 120, specific embodiments of which will be subsequently described in more detail. The hydraulic power unit 114 also provides power to a spotting system brake 122, the cooperation of which with the positioner 120 will be subsequently described in more detail.

In the semi-automatic spotting system of the present invention, the programmable logic controller 110 includes a processor having a minimum of 6K memory, 16 bits of discreet inputs, 16 bits of discreet outputs, a chassis and a power supply for the chassis. The encoder 106 is a 500 count encoder/pulse generator which includes a high speed counter/pulse module. The operator I/O interface 112 is a Panelview display unit. Additionally, there is a limit switch (not shown) mounted along the length of chain 104 for reset of the spotting operation.

In the fully automatic spotting system of the present invention, the programmable logic controller 110 includes a processor having a minimum 8K memory, 16 bits of discrete inputs, 24 bits of discrete outputs, a chassis and power supply for the chassis. The encoder 106 is a 500 count encoder/pulse generator with a high speed counter/pulse module. The operator I/O interface 112 is a Panelview display unit, and there is a limit switch (not shown) mounted along the length of the chain 104 for reset of the spotting operation. There is also a motor controller 124 which is added between the programmable logic controller 110 and the motor 102 which drives drive assembly 100.

Describing now the absolute spotting positioner 120, there are three embodiments of this positioner 120 contemplated by the invention. Two embodiments are of the disk clutch variety while the third is of the band clutch variety.

Figure 4:
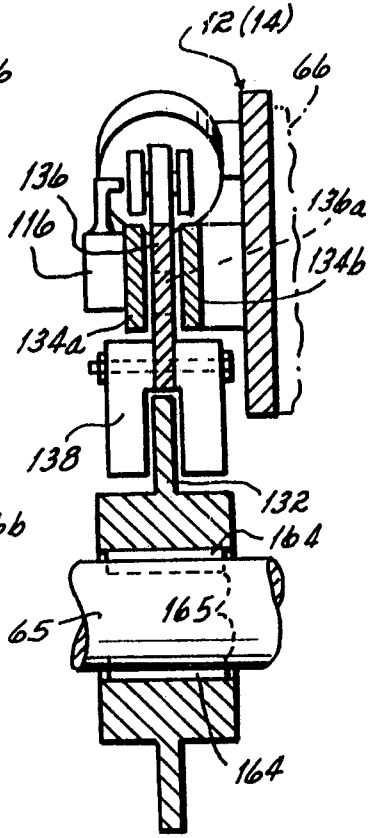
FIG. 4 is a view taken along line 4—4 FIG. 3.
Figure 3:
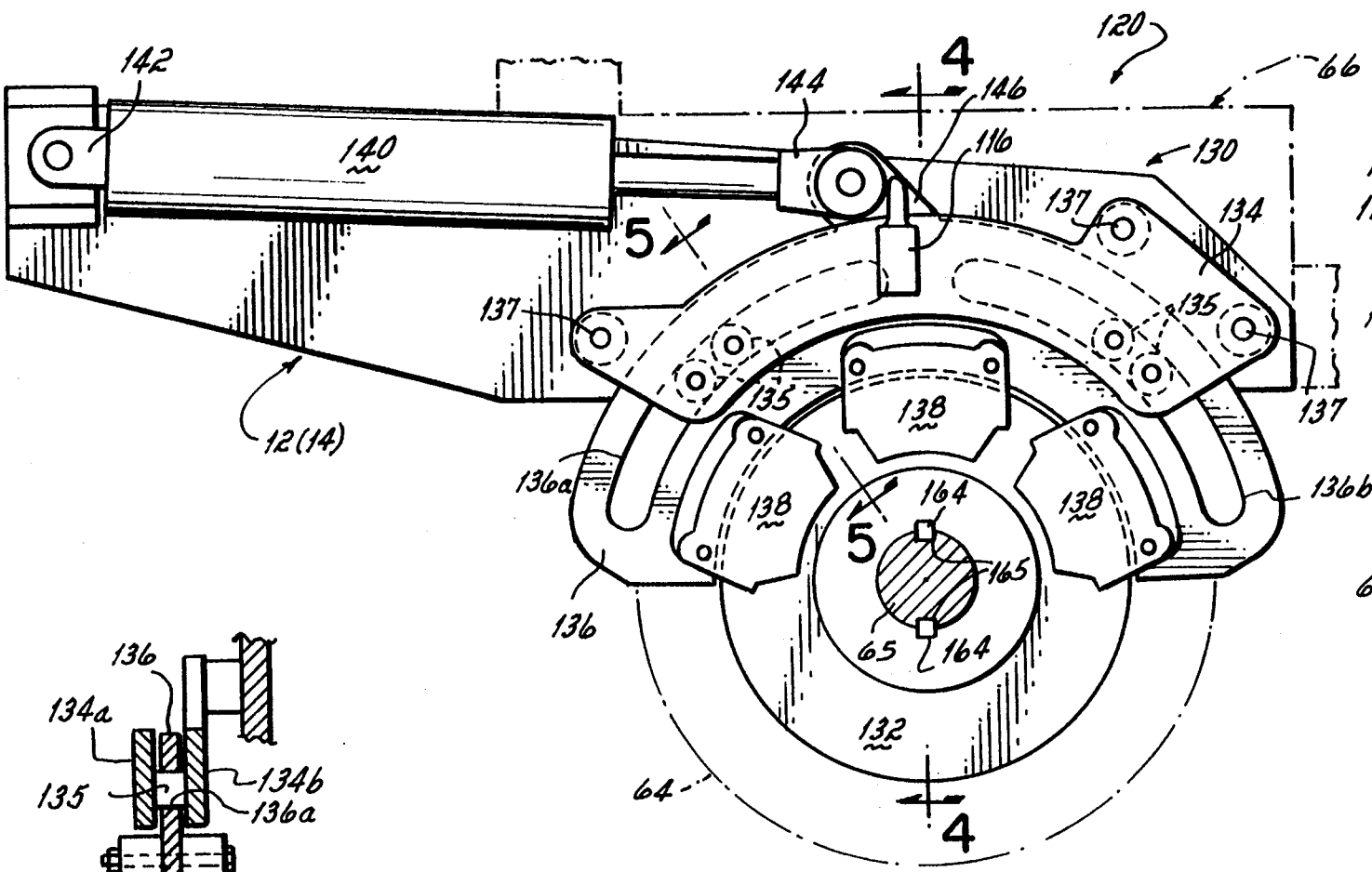
FIG. 3 is a side elevational view of one embodiment of the second automatically controlled drive of the spotting system.
Figure 5:
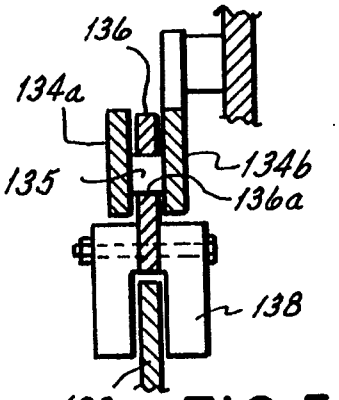
FIG. 5 is a view taken along line 5—5 of FIG. 3.
Figure 6:
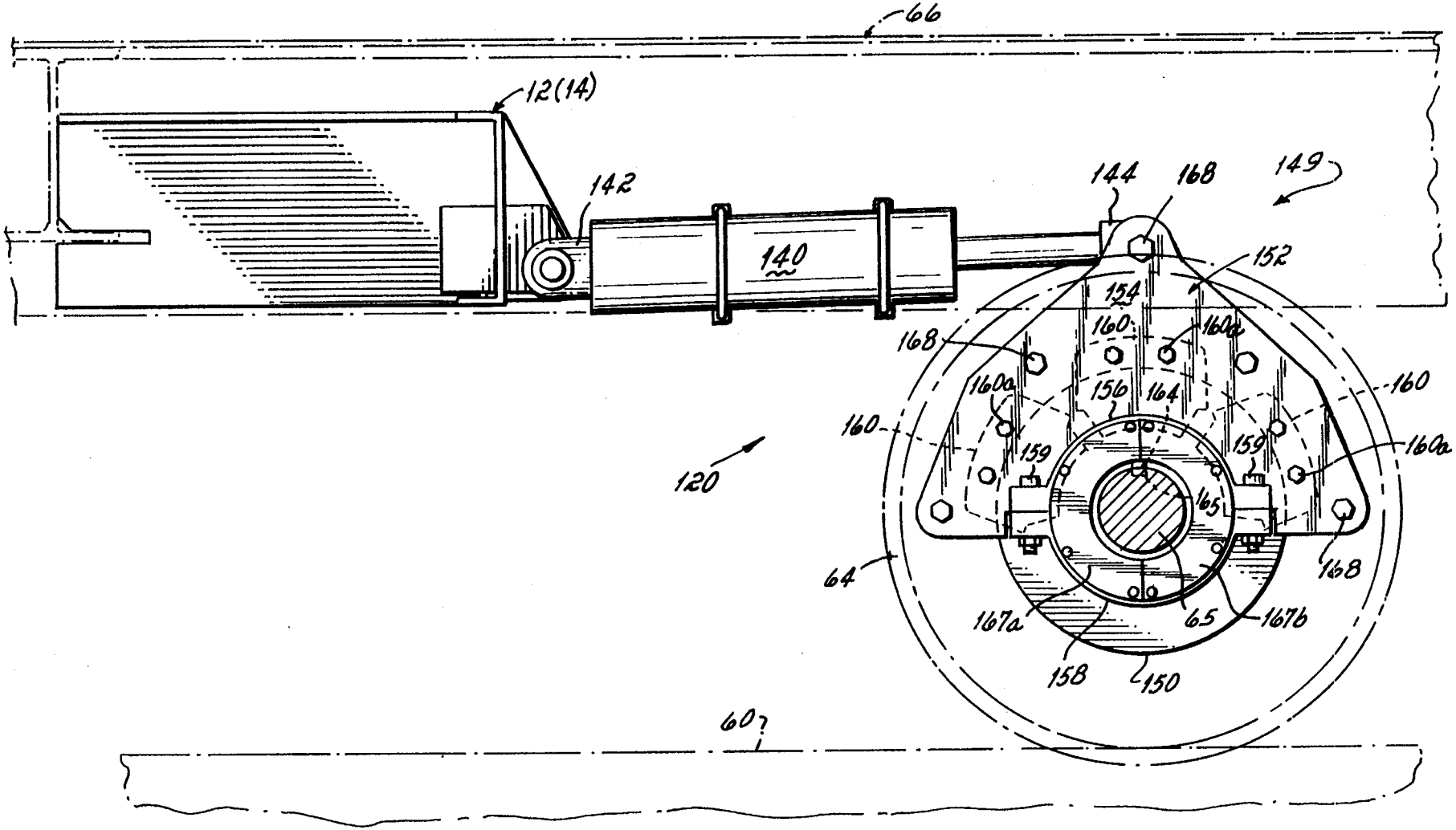
FIG. 6 is a side elevational view of another embodiment of the second automatically controlled drive of the spotting system.
Figure 7:
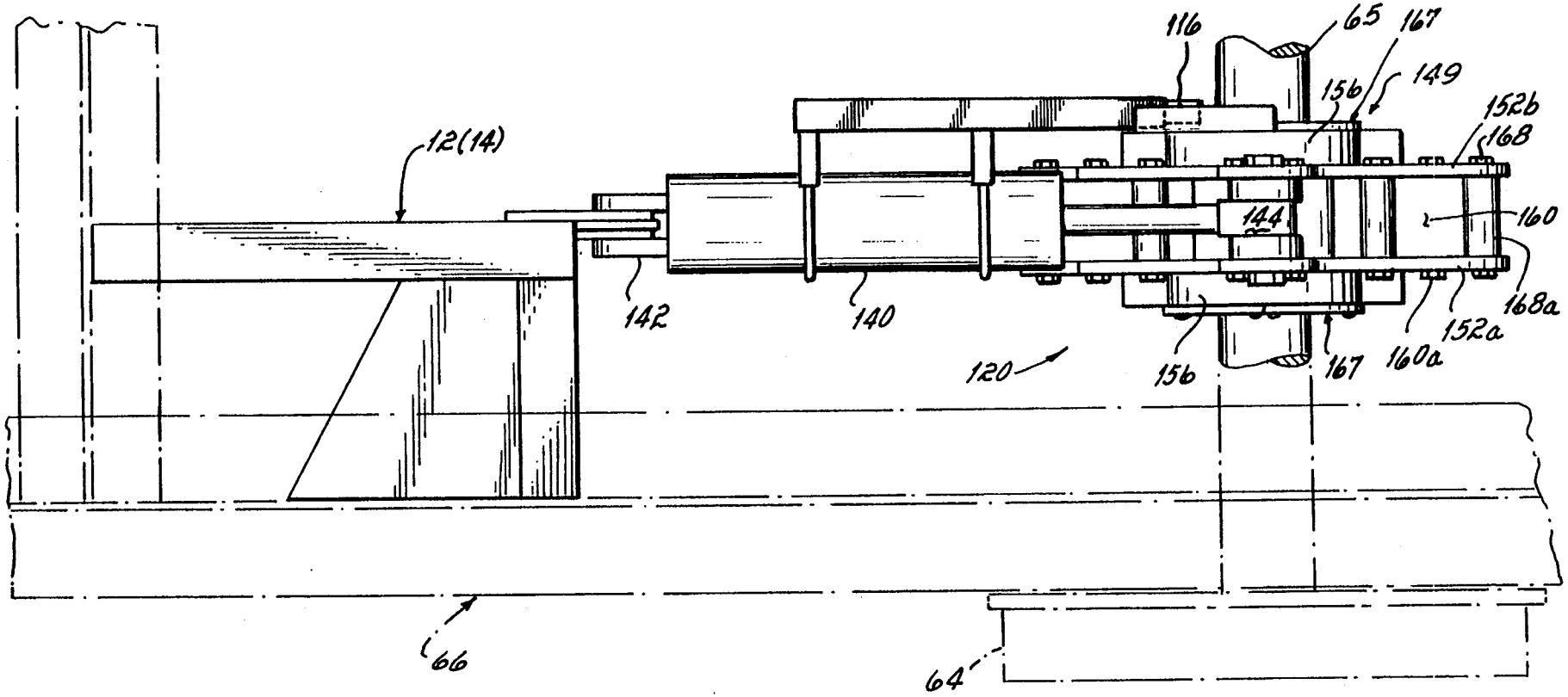
FIG. 7 is a top plan view of the drive of FIG. 6.
Figure 8:
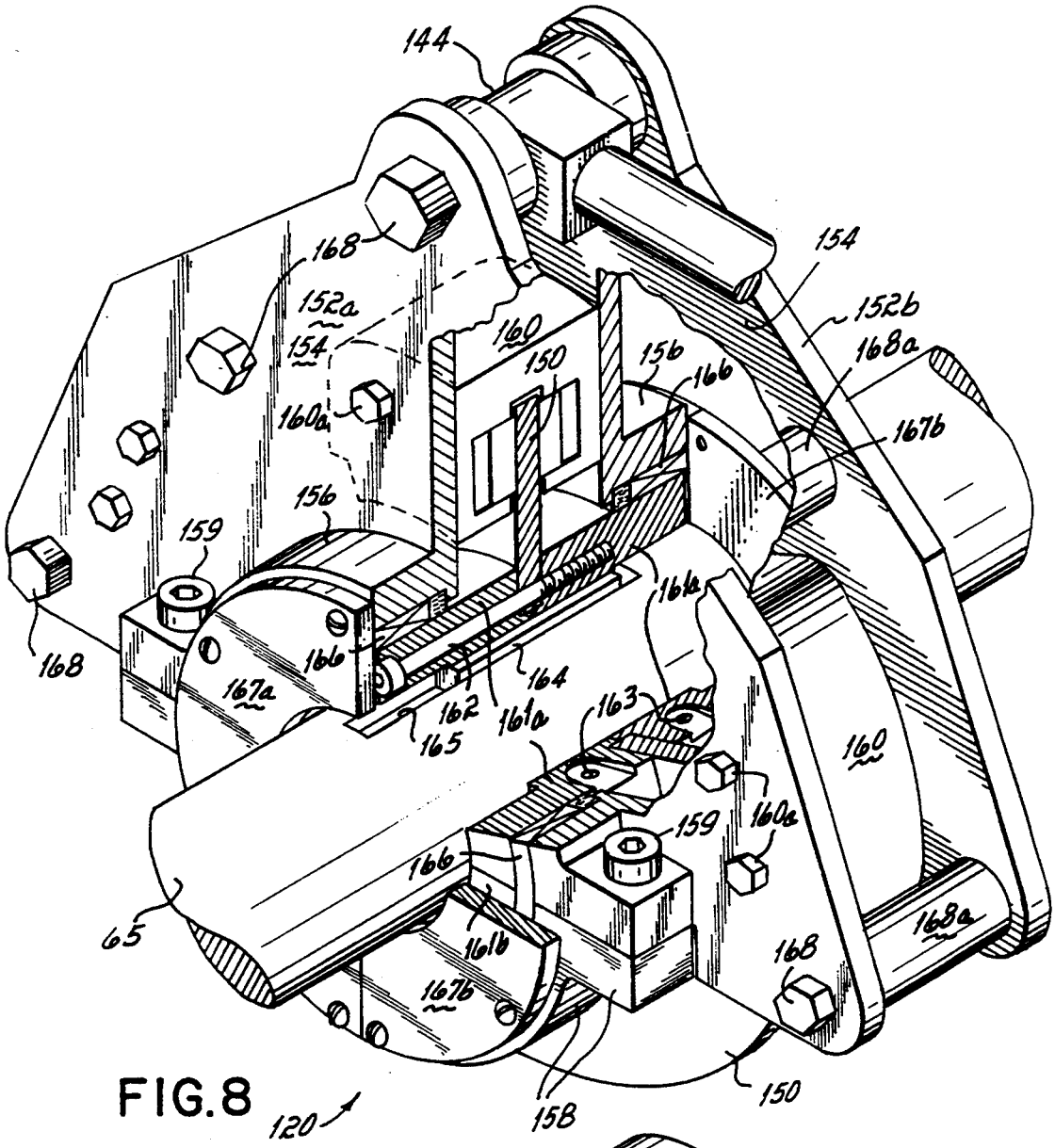
FIG. 8 is a perspective view, partially broken away, of the drive of FIGS. 6 and 7.
Figure 9:
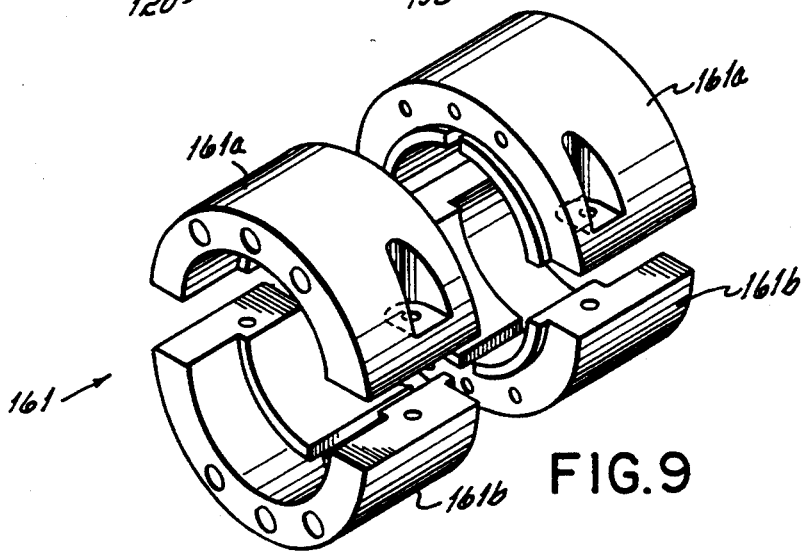
FIG. 9 is an exploded perspective view of a portion of the drive of FIGS. 6–8.

In FIGS. 3–5, one of the disk clutch type mechanisms is illustrated at 130. The mechanism 130 includes a disk 132 fixedly mounted to one of the axles 65 as by key 164 in keyway 165, or other suitable means. A support bracket 134 is mounted to the pusher machine 12 or door machine, and a caliper bracket 136 is movably mounted on the support bracket 134. As best seen in FIGS. 4 and 5, the support bracket 134 includes support bracket halves 134*a* and 134*b* with rollers 135 spanning between the bracket halves 134*a*, 134*b*. Caliper bracket 136 includes a pair of arcuately shaped elongated slots 136*a*, 136*b*. Rollers 135 are positioned in the slots 136*a*, 136*b* allowing the caliper bracket 136 to rotate about the disk 132 and about the wheel 64 axis of rotation. Connected to the caliper bracket 136 are three hydraulic calipers 138, 138, 138 for cooperation with the disk 132. The programmable logic controller 110 controls the hydraulic calipers 138 to clamp and release them to and from the disk 132 by sending appropriate signals to the hydraulic power unit 114.

A hydraulic cylinder 140 has a cylinder end 142 attached to the structure of the door or pusher machine 12 and a piston end 144 attached to an upwardly projecting lug 146 of the caliper bracket 136. As with the disk calipers, the programmable logic controller 110 is operable to extend and retract the hydraulic cylinder 140 by sending appropriate signals to the hydraulic power unit 114. The operation of the absolute spotting positioner 120 will be described more fully subsequently during discussion of the flowchart of the program controlled operation of FIG. 11.

Referring now to FIGS. 6–9, the other embodiment of the disk clutch type mechanism of the absolute spotting positioner 120 is illustrated as 149. In this embodiment, and with like numbers representing like components, the mechanism 149 comprises a disk 150 fixedly secured to one of the wheel axles 65. A caliper bracket 152 takes the form of a pair of caliper bracket halves 152*a*, 152*b* each of which includes a plate portion 154 and a semi-circular hub portion 156 fixedly secured to the plate portion 154. There is a lower semicircular hub portion 158 which mates with each of the hub portions 156 and is secured thereto with fasteners 159. Mounted between the plate portions 154, 154 of each of the caliper bracket halves 152*a*, 152*b* are three hydraulic caliper assemblies 160, 160, 160 which cooperate with disk 150 and which are secured to plate portions 154, 154 with fasteners 160*a*. Disk 150 is fixedly secured between two pairs of disk hubs 161, 161, each of the pairs 161, 161 comprising an upper semicircular hub half 161*a* and a lower semicircular hub half 161*b*. Disk 150 is secured between the disk hub pairs 161, 161 via threaded fasteners 162. Additionally, each upper hub half 161*a* is secured to its respective lower hub half 161*b* via fasteners 163. Upper hub halves 161*a*, 161*a* of each of the hub pairs 161, 161 are keyed or otherwise fixedly secured to shaft 65 as by key 164 residing in keyway 165 in shaft 65, or may be fixed in any other conventional manner. A pair of bearings 166, 166 allows the caliper bracket halves 152*a*, 152*b* to rotate relative to the disk 150 and disk hub pairs 161, 161. A pair of semicircular bearing retainer plates 167*a*, 167*b* are secured to hub 152*a* with fasteners 169.

As in the prior disk clutch embodiment, a hydraulic cylinder 140 has its cylinder end 142 connected to the pusher side machine 12 structure, while the piston end 144 of the hydraulic cylinder 140 is connected to a fastener 168 which secures the piston end 144 between the bracket halves 152*a*, 152*b*. Additional fasteners 168 secure stand-offs 168*a* between bracket halves 152*a*, 152*b*. Also as in the prior disk clutch embodiment, the programmable logic controller 110 is operable to clamp and release the hydraulic calipers 160 from the disk 150 and to extend and retract the hydraulic cylinder 140 by sending appropriate signals to the hydraulic power unit 114, the operation of which will be subsequently described in more detail in conjunction with the description of the flowchart of the program controlled operation of FIG. 11.

Figure 10:
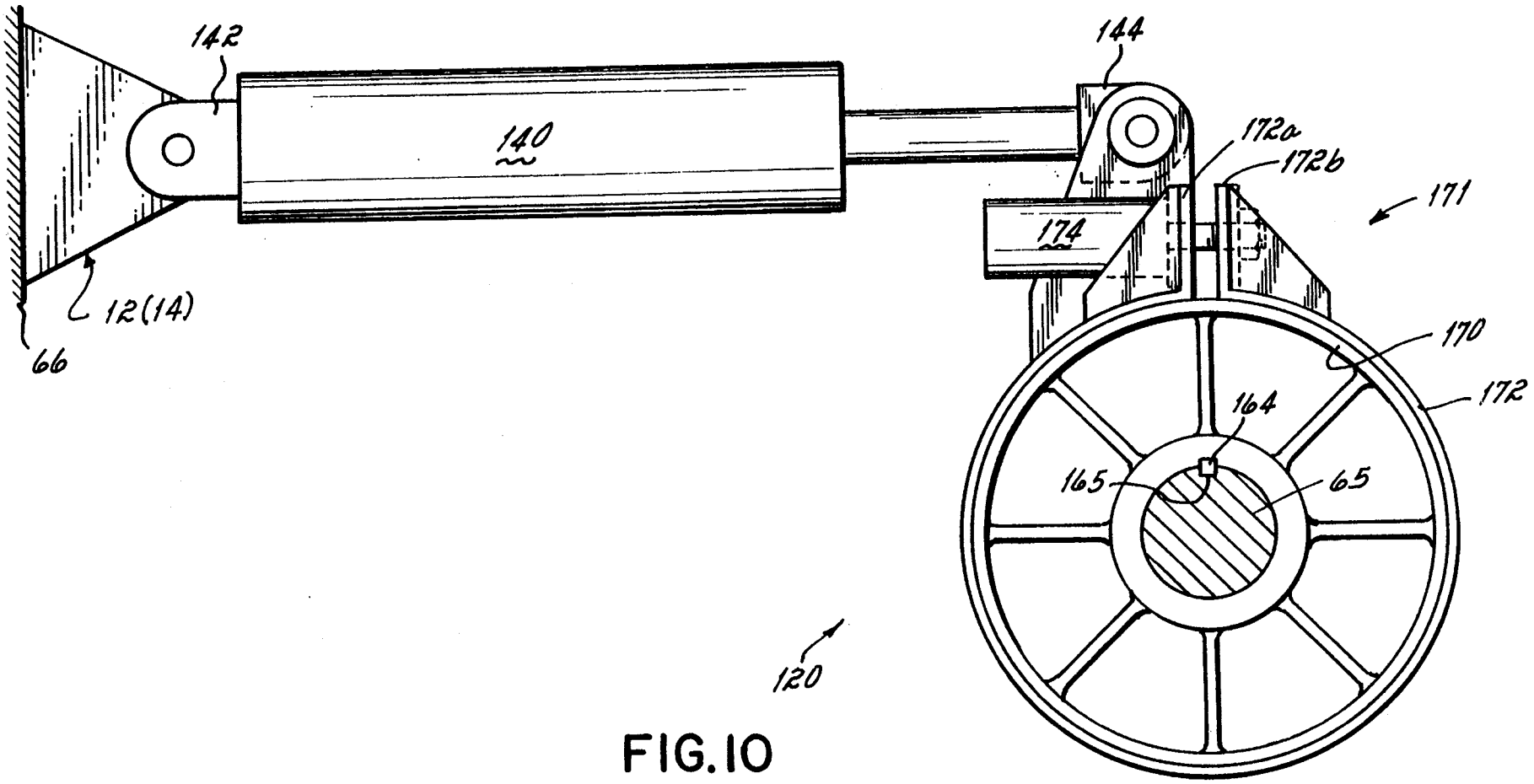
FIG. 10 is a side elevational view of a third embodiment of the second automatically controlled drive of the spotting system.

Referring now to FIG. 10, there is illustrated yet another embodiment of the absolute spotting positioner 120, which takes the form of a band clutch mechanism illustrated at 171. In this embodiment, and again with like numbers designating like components, there is a drum 170 fixedly connected to axle 65 as by key 164 in keyway 165 or other suitable means. Encircling the drum 170 is a band 172 which has opposite end brackets 172*a* and 172*b* connected together with a band tightening hydraulic cylinder 174. As in the prior embodiments, hydraulic cylinder 140 has a cylinder end 42 connected to the pusher machine 12 structure and a piston end 144 connected to band end bracket 172*a*. As in the prior embodiments, the programmable logic controller 110 is operable to clamp and release the band 172 via the band tightening hydraulic cylinder 174 and to extend and retract the hydraulic cylinder 140 by sending appropriate signals to the hydraulic power unit 114 the operation of which will be described subsequently in more detail in conjunction with the flowchart of the programmed controlled operation of FIG. 11.

Figure 11:
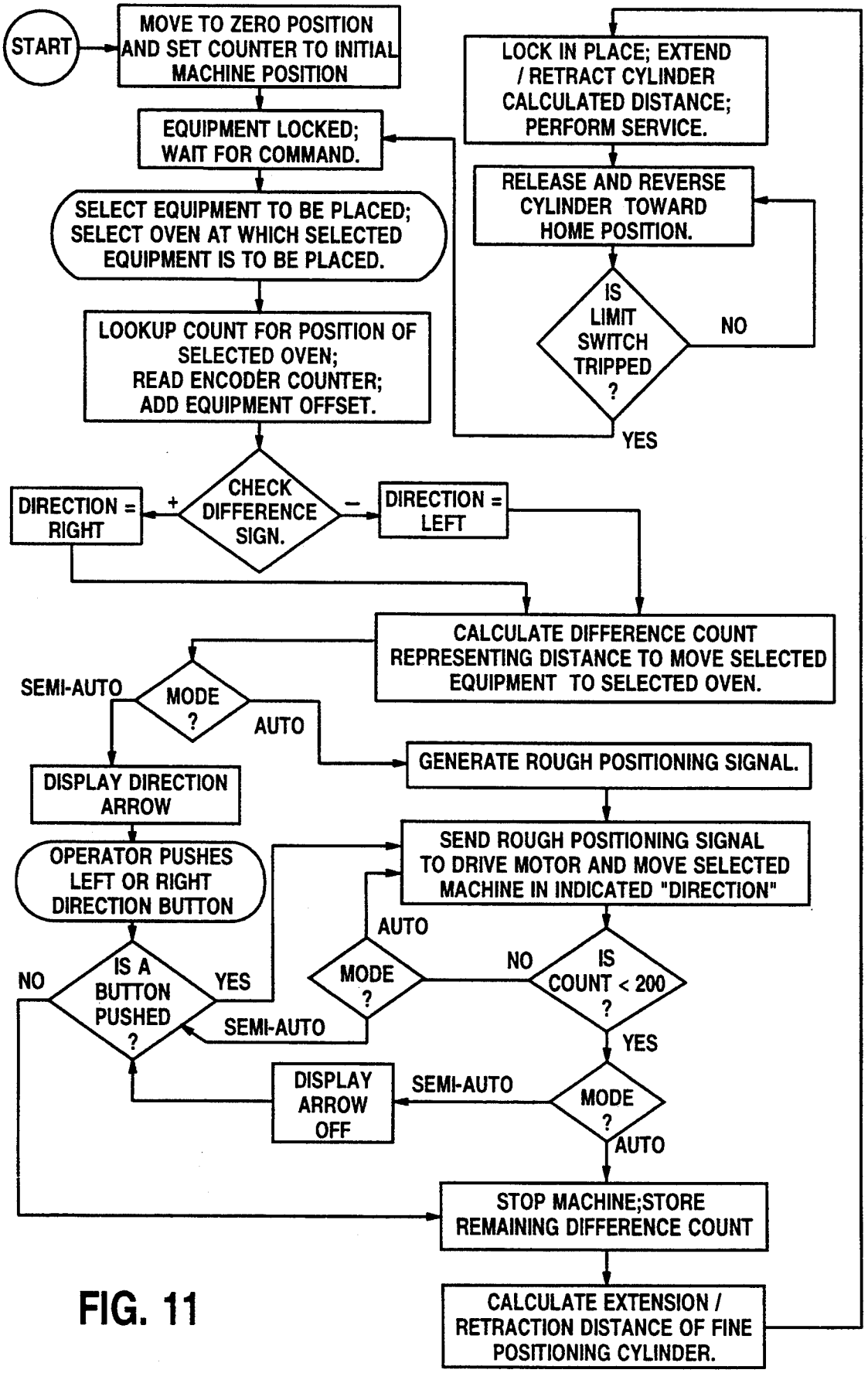
FIG. 11 is a flowchart of the program controlled operation of the spotting system of FIGS. 1–10.

The operation of the present invention is illustrated by the flowchart of FIG. 11, which represents the program loaded into a memory and executed by a microprocessor within the controller 110 (FIG. 2). In the system of the present invention, and referring now to FIGS. 1–11, an operator first selects the piece of functional equipment to be placed on spot. The operator might select, for example with the system of the present invention installed on the pusher side machine, the respective pusher side door extractor, door cleaner, jamb cleaner, pusher ram, or leveler, or for example with the system of the present invention installed on the door or coke side machine, the respective coke side door extractor, door cleaner, jamb cleaner, or coke guide. Each piece of equipment, which is carried by either the machine 12 or machine 14, is mounted at a different position on the machine 12 (14), and thus requires a slightly different position of the machine 12 (14) with respect to a selected oven for its use. Therefore, the selection of the piece of equipment is in effect the selection of an offset distance that must be added or subtracted from the final rest position of the machine 12 (14) adjacent the oven at which it is to be placed. Having selected the piece of equipment to be spotted, the operator then selects the particular oven for which the selected piece of functional equipment is to be placed on spot relative thereto. The operator selects these two items, that is functional equipment and oven, by simply pressing the appropriate buttons on the Panelview display operator I/O interface 112.

Once these two selections have been made, the Panelview display operator interface 112 sends an appropriate signal to the programmable logic controller 110. The logic controller 110 has stored in a memory within it a count representing the position of the machine 12 with respect to the assembly of ovens 20–24, or, more precisely, with respect to a reference point at one end of the bank of ovens. The precision with which the position is represented is determined by the resolution of the encoder/pulse generator 106. In the system described above, the encoder/pulse generator generates 500 pulses per revolution of its shaft, which is translated by the gear and sprocket ratio connected to the shaft into a distance of 0.025 inch per count. Thus, the memory records the exact position of the machine 12 to 0.025 inch accuracy with respect to the ovens. The interface 112 and controller 110 are provided with means for initially calibrating the counter to "zero" the count to a known initial reference position, at a given position of the track or rails 60, 62 (88, 90) as by a limit switch (not shown). This "zero" count is automatically set when the machine is powered up and traveled to its initial reference position (limit switch), whereupon the counter is initially set. Then, for every 0.025 inch that the machine moves thereafter from the initial position, the count in the counter is increased or decreased by a count of one, depending on the direction of travel.

Thus, when the controller 110 receives the settings from the operator via the interface 112, the controller will already have received a signal from the encoder 106 and calculated the exact position, within 0.025 inch, of the machine 12 with respect to the bank of ovens. This position may be at the initial reference position, or, if the machine 12 (14) has been moved, may be at the last position to which it was moved. The programmable logic controller 110 then determines the distance the machine is to be traveled by calculating the difference between the count that represents the position of the machine 12 (14) and the count that would represent the position of the machine 12 (14) if accurately positioned at the oven that has been selected by the operator. The oven position is a number stored in memory in the controller 110 for each oven, and represents the count for an arbitrary, for example centered, position of the machine 12 (14) at the selected oven. The oven position count is, however, offset to account for the offset distance of the selected piece of equipment from the center reference point of the machine 12 (14), by adding or subtracting an offset number, corresponding to which piece of equipment has been selected, to or from the centered position. Based on this calculated difference in count, the controller 110 sends a signal to the operator interface 112.

In the semi-automatic version of the system, the operator is prompted with the direction in which the machine 12 (14) must travel, and the operator must manually operate the travel controller to move the machine 12 (14) in the correct direction indicated on the Panelview display. When the machine 12 (14) arrives within approximately five (5) inches of the destination position relative to the selected oven, which it will do if the operator holds down the travel controller, the display changes, informing the operator to stop the machine 12 (14). By releasing the travel controller the motion of the machine 12 (14) stops.

In the fully automatic version of the system, or when operating in a fully automatic mode, the machine 12 (14) moves to the calculated first or rough position without the operator operating the travel controller via pushing a selected direction travel button on the Panelview display. In this automatic mode, in response to the calculated difference signal from the controller 110, the operator interface 112 still illuminates a display indicator on its panel to inform the operator of the direction in which the machine 12 (14) is to be moved in order to place the functional equipment on spot relative to the selected oven. The machine 12 (14), however, will automatically travel in the direction for which the Panelview display is indicating the machine must be moved to place the functional equipment on spot. To do this, the Panelview display 112 sends a signal to the programmable logic controller 110, which sends a first or rough positioning signal to the motor 102 to engage drive assembly 100.

In response to the first or rough positioning signal, the motor 102 engages the drive assembly 100 and drives the machine 12 (14) in the indicated direction of travel. As the machine 12 (14) travels, the encoder continues to send pulses to the controller 110, one for each 0.025 of an inch of travel of the machine 12 (14) with respect to the ovens, which pulses are subtracted from the difference count that had been calculated. When the machine is within approximately five (5) inches from the true on spot location, that is, when the difference count has been decremented or incremented by the addition or subtraction of the pulses to or from a predetermined count, the programmable logic controller 110 sends a signal to the motor 102 and the motor 102 ceases to drive the drive assembly 100.

After the first or rough positioning motion has stopped the machine 12 (14) within approximately five (5) inches of its destination, the programmable logic controller 110 then sends a fine positioning signal to the hydraulic power unit 114 for powering the absolute spotting positioner 120. Based on the distance that the functional equipment is from the true on spot location, which might be represented by a difference count of 200 or of some other count near 200 that depends on how precisely the machine 12 (14) was brought to a stop, the programmable logic controller 110 sends an appropriate signal to the hydraulic power unit 114, to clamp the disk calipers or clutch band and either extends or retracts the hydraulic cylinder 140 as necessary to rotate the caliper bracket 136 or 152 or the clutch band 172 through an arc which will result in the desired amount of linear travel. The extension or retraction distance necessary to bring about the rotation that corresponds exactly to that which will move the machine 12 (14) to its final desired position is the distance it will travel. Once the caliper bracket 136 or 152 or clutch band 172 has been moved to the correct location by the hydraulic cylinder 140, the hydraulic positioner 120 then holds the machine 12 (14) motionless relative to the set of tracks 60, 62 (88, 90). Thus, when the desired location is reached, the machine 12 (14) will stop precisely, within approximately ⅛ of an inch, from the desired oven position. This distance will correspond to a zero difference count in the memory of the controller 110. The machine 12 (14) and its corresponding functional equipment is at that point precisely on spot relative to the selected oven, and the programmable logic controller 110 sends a signal to the display 112 to so indicate the same. The oven may then be serviced in the usual manner by the functional equipment. After the service has been performed the programmable logic controller 110 sends another signal to the hydraulic power unit 114 which releases the calipers 138 or 160 or the clutch band tensioning cylinder 174. At that point the programmable logic controller 110 then sends another signal to the hydraulic power unit 114 which moves the hydraulic cylinder 140 in the reverse direction, or back to the home position as indicated by the home limit switch 116.

Once the home switch 116 indicates that the hydraulic cylinder 140 is back in the home location, the home switch 116 sends a signal to the programmable logic controller 110 which in turn sends a signal to the hydraulic power unit 114 ceasing operation of the hydraulic cylinder 140.

Thus, in the fully automatic version of the present invention, the step of manually traveling the machine 12 (14) to within approximately five (5) inches of the selected oven is eliminated, as an operator simply enters the desired oven number and the functional equipment with which to engage the oven into the Panelview 112, which sends a signal to the programmable logic controller 110, which sends a signal to the motor controller 124, which actuates the motor 102, which in turn actuates drive assembly 100 to automatically place the machine 12 (14) within approximately 5 inches of the selected oven. In response to the count from the encoder 106, the programmable logic controller 110 sends a signal to the motor controller 124 to disengage the motor 102 by sending a signal to the hydraulic power unit 114, which in turn controls the hydraulic cylinder 140 and calipers 138 or 160, or brake band tensioning cylinder 174, in the same manner as in the semi-automatic form of the invention to place the functional equipment on spot.

Those skilled in the art will readily recognize numerous adaptations and modifications which can be made to the coke oven rail car drive control system of the present invention which will result in an improved drive control system, yet all of which will fall within the spirit and scope of the present invention as defined in the claims. For example, in the above description reference has been made to the spotting positioner 120 used in conjunction with the pusher machine 12, but of course those skilled in the art will readily recognize that the positioner 120 could as well be, and would preferably be, used in conjunction with the door machine 14. In addition, the spotting positioner 120 could be as well mounted on an idler axle rather than on a drive axle as illustrated. Accordingly, the invention is to be limited only by the scope of the following claims and their equivalents.

What is claimed is:

1. A combination comprising:

a car adapted to roll on rails adjacent to and along the length of a coke oven battery which includes a plurality of coke ovens;

a sensor for determining the relative position of said car with respect to a selected oven in the battery;

a first drive for effecting gross movement of said car along the rails and gross positioning of said car relative to the selected oven on the basis of a first position determined by said sensor of said car relative to the selected oven; and a second automatically controlled drive operably rotatably connected to a wheel of the car for effecting fine movement of said car along the rails and fine positioning of said car relative to the selected oven on the basis of a second position determined by said sensor of said car relative to the selected oven.

2. A combination comprising:

a car adapted to roll on rails adjacent to and along the length of a coke oven battery which includes a plurality of coke ovens;

a sensor for determining the relative position of said car with respect to a selected oven in the battery;

a first manually controlled drive for effecting gross movement of said car along the rails and gross positioning of said car relative to the selected oven on the basis of a first position determined by said sensor of said car relative to the selected oven; and a second automatically controlled drive operably rotatably connected to a wheel of the car for effecting fine movement of said car along the rails and fine positioning of said car relative to the selected oven on the basis of a second position determined by said sensor of said car relative to the selected oven.

3. The combination of claim 2 wherein said first manually controlled drive comprises:

a first drive assembly;

a motor for driving said first drive assembly; and a manual operator controller for manually controlling said motor whereby an operator can position said car in a first selected position relative to the selected oven with said first drive assembly.

4. The combination of claim 3 wherein said second automatically controlled drive comprises:

a second drive assembly;

an actuator for actuating said second drive assembly; and an automatic controller for automatically controlling said actuator and said second drive assembly whereby said car is automatically positioned in a second selected position relative to the selected oven with said second drive assembly.

5. The combination of claim 4 wherein said second drive assembly comprises a band brake mechanism for driving a wheel axle of said car, and said actuator comprises a hydraulic cylinder connected between said car and said band brake mechanism.

6. The combination of claim 5 wherein said band brake mechanism comprises:

a drum mounted to said wheel axle;

a brake band encircling said drum; and a band tightening cylinder connected to opposite ends of said band;

said automatic controller being operable to clamp and release said brake band to and from said drum with said band tightening cylinder and for extending and retracting said hydraulic cylinder.

7. The combination of claim 5 further including a brake, said automatic controller being operable to actuate said brake for decelerating said car and maintaining said car in said second selected position.

8. A combination comprising:

a car adapted to roll on rails adjacent to and along the length of a coke oven battery which includes a plurality of coke ovens;

a sensor for determining the relative position of said car with respect to a selected oven in the battery;

a first manually controlled drive for effecting gross movement of said car along the rails and gross positioning of said car relative to the selected oven on the basis of a first position determined by said sensor of said car relative to the selected oven; and a second automatically controlled drive for effecting fine movement of said car along the rails and fine positioning of said car relative to the selected oven on the basis of a second position determined by said sensor of said car relative to the selected oven;

said first manually controlled drive comprising:

a first drive assembly;

a motor for driving said first drive assembly;

a manual operator controller for manually controlling said motor whereby an operator can position said car in a first selected position relative to the selected oven with said first drive assembly;

said second automatically controlled drive comprising:

a second drive assembly;

an actuator for actuating said second drive assembly; and an automatic controller for automatically controlling said actuator and said second drive assembly whereby said car is automatically positioned in a second selected position relative to the selective oven with said second drive assembly;

said second drive assembly comprising a disk clutch mechanism for driving a wheel axle of said car, and said actuator comprising a hydraulic cylinder connected between said car and said disk clutch mechanism.

9. The combination of claim 8 wherein said disk clutch mechanism comprises:

a disk mounted to said wheel axle;

a support bracket mounted to said car adjacent said axle;

a caliper bracket movably mounted on said support bracket, said caliper bracket being moveable relative to said support bracket about an axis of rotation of said wheel axle, said caliper bracket including at least one caliper thereon for cooperation with said disk;

said automatic controller being operable to clamp and release said at least one caliper to and from said disk and for extending and retracting said hydraulic cylinder.

10. The combination of claim 8 wherein said disk clutch mechanism comprises:

a disk mounted to said wheel axle;

a caliper bracket mounted to a hub, said hub being movably mounted relative to said wheel axle about an axis of rotation of said wheel axle, said caliper bracket including at least one caliper thereon for cooperation with said disk;

said automatic controller being operable to clamp and release said at least one caliper to and from said disk and for extending and retracting said hydraulic cylinder.

11. The combination of claim 8 further including a brake, said automatic controller being operable to actuate said brake for decelerating said car and maintaining said car in said second selected position.

12. A combination comprising:

a car adapted to roll on rails adjacent to and along the length of a coke oven battery which includes a plurality of coke ovens;

a sensor for determining the relative position of said car with respect to a selected oven;

a first automatically controlled drive for effecting gross movement of said car along the rails and gross positioning of said car relative to the selected oven on the basis of a first position determined by said sensor of said car relative to the selected oven; and a second automatically controlled drive operably rotatably connected to a wheel of the car for effecting fine movement of said car along the rails and fine positioning of said car relative to the selected oven on the basis of a second position determined by said sensor of said car relative to the selected oven.

13. The combination of claim 12 wherein said first automatically controlled drive means comprises:

a first drive assembly;

a motor for driving said first drive assembly; and a first automatic controller for automatically controlling said motor whereby said car is automatically positioned in a first selected position relative to the selected oven with said first drive assembly.

14. The combination of claim 13 wherein said second automatically controlled drive comprises:

a second drive assembly;

an actuator for actuating said second drive assembly; and a second automatic controller for automatically controlling said actuator and said second drive assembly whereby said car is automatically positioned in a second selected position relative to the selected oven with said second drive assembly.

15. The combination of claim 14 wherein said second drive assembly comprises a band brake mechanism for driving a wheel axle of said car, and said actuator comprises a hydraulic cylinder connected between said car and band brake mechanism.

16. The combination of claim 15 wherein said band brake mechanism comprises:

a drum mounted to said wheel axle;

a brake band encircling said drum; and a band tightening cylinder connected to opposite ends of said band;

said automatic controller being operable to clamp and release said brake band to and from said drum with said band tightening cylinder and for extending and retracting said hydraulic cylinder.

17. The combination of claim 15 further including a brake, said automatic controller being operable to actuate said brake for decelerating said car and maintaining said car in said second selected position.

18. A combination comprising:

a car adapted to roll on rails adjacent to and along the length of a coke oven battery which includes a plurality of coke ovens;

a sensor for determining the relative position of said car with respect to a selected oven;

a first automatically controlled drive for effecting gross movement of said car along the rails and gross positioning of said car relative to the selected oven on the basis of a first position determined by said sensor of said car relative to the selected oven; and a second automatically controlled drive for effecting fine movement of said car along the rails and fine positioning of said car relative to the selected oven on the basis of a second position determined by said sensor of said car relative to the selected oven;

said first automatically controlled drive means comprising:

a first drive assembly;

a motor for driving said first drive assembly; and a first automatic controller for automatically controlling said motor whereby said car is automatically positioned in a first selected position relative to the selected oven with said first drive assembly;

said second automatically controlled drive comprising:

a second drive assembly;

an actuator for actuating said second drive assembly; and a second automatic controller for automatically controlling said actuator and said second drive assembly whereby said car is automatically positioned in a second selected position relative to the selected oven with said second drive assembly;

said second drive assembly comprising a disk clutch mechanism for driving a wheel axle of said car, and said actuator comprising a hydraulic cylinder connected between said car and said disk clutch mechanism.

19. The combination of claim 18 wherein said disk clutch mechanism comprises:

a disk mounted to said wheel axle;

a support bracket mounted to said car adjacent said axle;

a caliper bracket movably mounted on said support bracket, said caliper bracket being moveable relative to said support bracket about an axis of rotation of said wheel axle, said caliper bracket including at least one caliper thereon for cooperation with said disk;

said second automatic controller being operable to clamp and release said at least one caliper to and from said disk and for extending and retracting said hydraulic cylinder.

20. The combination of claim 18 wherein said disk clutch mechanism comprises:

a disk mounted to said wheel axle;

a caliper bracket mounted to a hub, said hub being movably mounted relative to said wheel axle about an axis of rotation of said wheel axle, said caliper bracket including at least one caliper thereon for cooperation with said disk;

said automatic controller being operable to clamp and release said at least one caliper to and from said disk and for extending and retracting said hydraulic cylinder.

21. The combination of claim 18 further including a brake, said automatic controller being operable to actuate said brake for decelerating said car and maintaining said car in said second selected position.

* * * * *

UNITED STATES PATENT AND TRADEMARK OFFICE

CERTIFICATE OF CORRECTION

PATENT NO. : 5,447,106

DATED : September 5, 1995

INVENTOR(S) : Billy C. Baird

It is certified that error appears in the above-indentified patent and that said Letters Patent is hereby corrected as shown below:

Title page, item [54] and col. 1, line 4,
In the Title, "Drinks" should be -- Drives --.

In the Abstract, line 10, "caw" should be -- car --.

Col. 8, line 22, "cylinder end 42" should be
-- cylinder end 142 --.

Signed and Sealed this

Thirtieth Day of January, 1996

*Attest:*

Bruce Lehman

BRUCE LEHMAN

*Attesting Officer*

*Commissioner of Patents and Trademarks*